US008323428B2

(12) United States Patent
Chipko et al.

(10) Patent No.: US 8,323,428 B2
(45) Date of Patent: Dec. 4, 2012

(54) HIGH STRAIN RATE FORMING OF DISPERSION STRENGTHENED ALUMINUM ALLOYS

(75) Inventors: Paul Chipko, Blairstown, NJ (US); Derek Raybould, Denville, NJ (US)

(73) Assignee: Honeywell International Inc., Morristown, NJ (US)

( * ) Notice: Subject to any disclaimer, the term of this patent is extended or adjusted under 35 U.S.C. 154(b) by 782 days.

(21) Appl. No.: 11/517,297

(22) Filed: Sep. 8, 2006

(65) Prior Publication Data

US 2010/0077825 A1 Apr. 1, 2010

(51) Int. Cl.
*C22F 1/04* (2006.01)

(52) U.S. Cl. ..... 148/691; 148/608; 148/695; 417/67

(58) Field of Classification Search ..... 419/67, 419/61, 66; 148/95, 559, 515, 688–704; 75/228–250, 255, 252–254, 746–773, 950–962
See application file for complete search history.

(56) References Cited

U.S. PATENT DOCUMENTS

| | | | | |
|---|---|---|---|---|
| 3,241,351 | A * | 3/1966 | Hautau et al. | 72/429 |
| 3,874,207 | A * | 4/1975 | Lemelson | 72/56 |
| 4,040,286 | A | 8/1977 | Abramowitz et al. | |
| 4,647,321 | A | 3/1987 | Adam | |
| 4,715,893 | A | 12/1987 | Skinner et al. | |
| 4,729,790 | A | 3/1988 | Skinner | |
| 4,828,632 | A | 5/1989 | Adam et al. | |
| 4,869,751 | A | 9/1989 | Zedalis et al. | |
| 5,296,190 | A | 3/1994 | Premkumar | |
| 5,826,456 | A | 10/1998 | Kawazoe et al. | |
| 6,056,835 | A | 5/2000 | Miyake et al. | |
| 6,253,588 | B1 | 7/2001 | Rashid et al. | |
| 6,712,916 | B2 | 3/2004 | Mishra et al. | |
| 6,962,673 | B2 | 11/2005 | Hattori et al. | |
| 2001/0001969 | A1 | 5/2001 | Yoshida et al. | |
| 2002/0011289 | A1 | 1/2002 | Warner | |
| 2004/0025981 | A1 | 2/2004 | Tack et al. | |
| 2004/0197532 | A1 | 10/2004 | Barnes | |
| 2004/0256441 | A1 * | 12/2004 | Serole et al. | 228/115 |
| 2005/0081594 | A1 | 4/2005 | Segal | |
| 2005/0236075 | A1 | 10/2005 | Gheorghe et al. | |

FOREIGN PATENT DOCUMENTS

| | | |
|---|---|---|
| EP | 0147769 | 7/1985 |
| GB | 687003 | 2/1953 |
| SU | 429873 | * 11/1974 |

OTHER PUBLICATIONS

Altan, T., and M. Shirgaokar, "Hammers and Presses for Forging," Metalworking: Bulk Forming, vol. 14A, ASM Handbook, ASM International, pp. 23-35, 2005. (10 pages total submitted).*
Kuhlman, G. W., "Forging of Aluminum Alloys," Metalworking: Bulk Forming, vol. 14A, ASM Handbook, ASM International, pp. 299-312, 2005. (4 pages total submitted).*
"Glossary of Metallurgical and Metalworking Terms," Metals Handbook, ASM International, 2002.*
European search report, EP 07115865.3, dated Jan. 28, 2008.

* cited by examiner

*Primary Examiner* — Roy King
*Assistant Examiner* — Vanessa Luk
(74) *Attorney, Agent, or Firm* — Ingrassia Fisher & Lorenz, P.C.

(57) ABSTRACT

Dispersion strengthened aluminum base alloys are shaped into metal parts by high strain rate forging compacts or extruded billets composed thereof. The number of process steps required to produce the forged part are decreased and strength and toughness of the parts are increased. The dispersion strengthened alloy may have the formula $Al_{bal}Fe_a$, $Si_bX_c$, wherein X is at least one element selected from Mn, V, Cr, Mo, W, Nb, and Ta, "a" ranges from 2.0 to 7.5 weight-%, "b" ranges from 0.5 to 3.0 weight-%, "c" ranges from 0.05 to 3.5 weight-%, and the balance is aluminum plus incidental impurities. Alternatively, the dispersion strengthened alloy may be described by the formula $Al_{bal}Fe_a,Si_bV_dX_c$, wherein X is at least one element selected from Mn, Mo, W, Cr, Ta, Zr, Ce, Er, Sc, Nd, Yb, and Y, "a" ranges from 2.0 to 7.5 weight-%, "b" ranges from 0.5 to 3.0 weight-%, "d" ranges from 0.05 to 3.5 weight-%, "c" ranges from 0.02 to 1.50 weight-%, and the balance is aluminum plus incidental impurities. In both cases, the ratio [Fe+X]:Si in the dispersion strengthened alloys is within the range of from about 2:1 to about 5:1.

12 Claims, No Drawings

HIGH STRAIN RATE FORMING OF DISPERSION STRENGTHENED ALUMINUM ALLOYS

FIELD OF THE INVENTION

The present invention relates to dispersion strengthened aluminum alloys, and in particular, to a process for forming such alloys into shaped parts having improved properties.

DESCRIPTION OF THE PRIOR ART

Aluminum base Al—Fe alloys have mechanical properties comparable to titanium alloys up to temperatures of around 350° C. and can, because of their lower density—2.9 compared to 4.5 g/cc—result in significant weight savings in several applications. Although properties of these dispersion strengthened alloys are attractive, applications have been restricted, due to the complexity of the fabrication process required to make useful shapes. The benefits that could potentially be derived through use of such alloys have heretofore been offset by the cost of fabricating the alloys into useful shapes. Also, the microstructure of the alloy coarsens during the forming operations, which have to be carried out at or above the alloys designed operating temperatures. This coarsening reduces the alloys strength and hence its potential benefits and range of applications. The dispersoids which give these rapidly solidified alloys their unique properties can not be redissolved into the aluminum matrix and subsequently reprecipitated during a suitable thermal cycle, as with conventional aluminum alloys. The complexity of the forming operations results in repeat exposure to these high temperatures, each of which adds cost to the part and reduces the strength of the alloy.

U.S. Pat. No. 4,647,321 discloses aluminum alloy compositions, powders of which are made by the rotating disc technique. The claims of this patent recite high strength aluminum alloy articles wherein the alloy contains iron, molybdenum, and optionally other elements (vanadium, titanium, zirconium, hafnium, niobium, tungsten, chromium), with the major portion of the alloy being aluminum.

U.S. Pat. No. 4,869,751 discloses thermo-mechanical processing of rapidly solidified high temperature aluminum base alloys. The processing involves hot rolling with a reduction of around 25% per pass.

U.S. Pat. No. 5,296,190 discloses an Al—Fe—Ce alloy produced by atomization (rather than by, for instance, spin casting). The patent indicates that cold hydrostatic extrusion of material which has already been hot extruded increases the total strain (deformation) that the material can subsequently undergo. U.S. Pat. No. 5,296,190 teaches that imparting cold work by hydrostatic extrusion alters the microstructure from that depicted in the patent's FIG. 1 to that depicted in the patent's FIG. 2, resulting in an increase in strength and high strain rate formability. However, cold hydrostatic extrusion is expensive and is limited to a relatively small diameter starting stock, which means that the extrudate is even smaller. The patent describes the manufacture of rivets, in which technology the small diameter of the extrusion is an advantage. However, the small size constraint and the expense of the procedure limits is suitability for other applications.

Dispersion strengthened aluminum alloys have to date been fabricated to shaped parts using a process generally including melting, followed by rapid solidification powder production, followed by degassing, followed by compaction under vacuum, followed by extrusion secondary forming, followed by rolling or forging. Despite the need for great care during the forming processes and the necessity to use modified equipment the alloys have been successfully extruded, rolled and forged into a variety of high strength parts. These are presently made by extruding a vacuum hot pressed billet of the dispersion strengthened alloy and then forging the extrusion in a series of steps, using special tooling which is preheated to a temperature close to that of the part being forged. The number of steps required and the complexity of the tooling are greater than for conventional aluminum, hence the cost of the forging is increased. In addition, the repeat exposure to the high forging temperature results in a coarsening of the microstructure and a loss in strength and in some cases ductility. However, there is still a need for a forming process and in particular a forging operation, which will produce useful shapes at a low cost and with no loss in strength, due to the necessity of excessive thermal exposure during forming.

SUMMARY OF THE INVENTION

The present invention provides a means for forming a dispersion strengthened, non heat treatable aluminum base alloy into near net shape forgings such as impellers for aircraft engines. It has surprisingly been found that the use of very high forging speeds, as obtainable by conventional hammer presses, allows the number of steps required to achieve a particular deformation to be significantly reduced, even when relatively low forging temperatures are employed. Advantageously, simpler dies which need not be preheated to the forging temperatures, can be used. Hence, forging costs are reduced and the final properties are increased.

These unexpected benefits are obtained in accordance with the invention by the use of impact presses for the forging of dispersion strengthened aluminum alloys. Strength and toughness are increased and processing costs are decreased over articles produced using modern forging techniques, such as isothermal forging, which would be expected to be preferential.

One embodiment of this invention is a process for forming a dispersion strengthened aluminum alloy to a shaped part. This process includes the steps of: (a) extruding or upsetting the alloy to produce stock; and (b) impact forging the stock with a steam hammer, an impact press, or a high energy rate forming press to produce shock waves within the stock.

More specifically, this may be a process for forming a rapidly solidified, dispersion strengthened aluminum alloy powder to a shaped part comprising the steps of: (a) extruding a billet made from said powder at an extrusion ratio of at least 4:1 to produce an extrudate; and (b) impact forging the extrudate using a plurality of dies to produce shock waves and high strain rates therewithin. The impact forging step may be carried out, for instance, using a steam hammer, an impact press, or a high energy rate forming press. The impact forging step is typically carried out at a temperature of at least 275° C., generally at a temperature in the range from about 275 to 450° C. Preferably, the temperature will be at least 300° C. and the dies will have a temperature of at least 200° C.

The stock as forged in step (b) typically has at least 95% of the strength of the stock extruded in step (a). The stock of the dispersion strengthened alloy forged as described herein normally has dispersoids that are near spherical in shape. By "near spherical in shape", we mean that the dispersoids are closer in shape to spheres than to rods. That is, they are rounded rather than elongate. The dispersion strengthened alloy generally comprises from 5 to 45 volume-% dispersoids.

The dispersion strengthened alloy of the present invention may have a composition described by the formula $Al_{bal}Fe_a$, $Si_bX_c$, wherein X is at least one element selected from the group consisting of Mn, V, Cr, Mo, W, Nb, and Ta, "a" ranges from 2.0 to 7.5 weight-%, "b" ranges from 0.5 to 3.0 weight-%, "c" ranges from 0.05 to 3.5 weight-%, and the balance is aluminum plus incidental impurities, with the proviso that the ratio [Fe+X]:Si is within the range of from about 2:1 to about 5:1.

Alternatively, the composition of the dispersion strengthened alloy of this invention may be described by the formula $Al_{bal}Fe_a,Si_bV_dX_c$, wherein X is at least one element selected from the group consisting of Mn, Mo, W, Cr, Ta, Zr, Ce, Er, Sc, Nd, Yb, and Y, "a" ranges from 2.0 to 7.5 weight-%, "b" ranges from 0.5 to 3.0 weight-%, "d" ranges from 0.05 to 3.5 weight-%, "c" ranges from 0.02 to 1.50 weight-%, and the balance is aluminum plus incidental impurities, with the proviso that the ratio [Fe+X]:Si is within the range of from about 2:1 to about 5:1.

DETAILED DESCRIPTION OF THE INVENTION

Alloys preferred for use in the process of the invention are the rapidly solidified high temperature aluminum alloys disclosed in U.S. Pat. Nos. 4,715,893, 4,729,790, and 4,828,632. Dispersion strengthened alloys especially suited for processing in accordance with this invention are described in detail in U.S. Pat. No. 4,729,790. Such alloys have a composition consisting essentially of the formula $Al_{bal}Fe_a,Si_bX_c$, wherein X is at least one element selected from the group consisting of Mn, V, Cr, Mo, W, Nb, Ta; "a" ranges from 2.0 to 7.5 at %; "b" ranges from 0.5 to 3.0 at %; "c" ranges from 0.05 to 3.5 at % and the balance is aluminum plus incidental impurities, with the proviso that the ratio [Fe+X]:Si is within the range from about 2.0:1 to 5.0:1.

The alloys of this invention are preferably based on Al—Fe—V—Si. In accordance with this invention, the dispersoid may be a fine, nearly spherical $Al_{12}(FeV)_3Si$ phase formed by decomposition of the rapidly solidified aluminum. This silicide dispersoid may make up from 5 to 45 volume-% of the alloy, preferably from 15 to 40 volume-%. This gives a range of alloy compositions all having a [Fe+V]:Si ratio within the range 2:1 to 5:1. These Al—Fe—V—Si alloys may contain from 0.02 to 0.5 wt-% of a fifth element, which may be Mn, Mo, W, Cr, Ta, Zr, Ce, Er, Sc, Nd, Yb, or Y.

In use, the high volume fraction alloys may be employed in applications that take advantage of their high stiffness, while the low volume fraction alloys have lower strength, and are easily formed into such products as rivets, etc., in which their lower strength, especially their high temperature strength, is sufficient.

To obtain the desired combination of strength and toughness the alloys appointed for use with the invention are rapidly solidified from the melt at cooling rates sufficient to produce a fine microstructure and intermetallic dispersoid. The quench rate from the molten state is preferably in the range of $10^{5}$° C./sec to $10^{7}$° C.; and is achieved by quenching techniques such as melt spinning, splat cooling or planar flow casting.

Quenching techniques such as melt spinning or planar flow casting produce a product having the form of a thin ribbon, which may thereafter be broken up to form a powder. This is readily achieved using a comminution device such as a pulverizer, knife mill, rotating hammer mill or the like. Preferably, the comminuted particles have a size ranging from −35 mesh to +200 mesh, US standard sieve size.

The ribbon or comminuted powder is degassed and compacted to form a relatively solid billet. Aluminum powders typically require degassing to remove water vapor associated with the oxide layer around the powder. In the present case degassing involves heating the powder under a vacuum preferably better than $10^{-3}$ Torr to temperatures in the range of 300 to 400° C. If the powder is heated in the blank die of a vacuum hot press, then it may be compacted, to preferably a density of over 90% theoretical, once it has reached temperature. Alternately, the ribbon or powder may be placed in a can on which a vacuum is pulled while it is heated to the degassing temperature. The can is then sealed and blank die compacted on an extrusion or forging press, or hot isostatically pressed, to produce typically a 100% dense billet.

The billet so produced is completely consolidated and the particles are bonded together by extrusion. A process such as extrusion is required because the high degree of shear which occurs during extrusion breaks down the tenacious oxide layer between the particles of aluminum, thus allowing interparticle bonding. If this oxide layer is not broken down, then the material will have poor ductility and toughness. The minimum extrusion ratio to break up this oxide layer is 4:1, but it should preferably exceed 10:1 and if no subsequent work (such as forging or rolling) is to be performed on the extrusion a ratio of at least 14:1 is desired. Ratios greater than 20:1 are, however, not desired as they increase the difficulty of extrusion, and provide negligible improvement in ductility or toughness. The extrusion temperature is preferably in the range of 300 to 450° C. As the extrusion temperature increases, the microstructure and dispersoids coarsen and strength is lost. Moreover, the alloys strength is so high at these temperatures that it is difficult to find extrusion presses having, on one hand, sufficient tonnage capacity and, on the other hand, tooling capable of withstanding the high pressures required. Extrusion on such presses at temperatures of 375° C. or lower results in minimal loss in strength. Similarly, conventional forging on hydraulic presses requires large capacity presses if the forging is to be carried out at a sufficiently low temperature to avoid coarsening the microstructure. Such presses are available, but are more expensive than those that would normally be used to forge aluminum parts.

Secondary operations such as rolling or forging are required to obtain the material in a usable form such as sheet or a complex shape. Such operations can be carried out on the alloys, but due to the high temperature strength of the alloys the temperatures used must often be increased to those at which significant microstructural coarsening occurs, and multiple small reductions are often employed, increasing the cost of the operation. U.S. Pat. No. 4,869,751 discloses rolling alloys at low temperatures of 300 to 350° C., but the reduction in thickness per pass through the rolling mill is said to be limited typically to less than 20% and, in some cases, to less than 5%. For aluminum alloys these are extremely small reductions. Similar problems are encountered when forging aluminum base alloys.

Investigations of the properties of the alloy as a function of temperature and speed of deformation indicated that deformation of the alloy should be most formable at high temperatures and low deformations rates, because increasing the strain rate increases the strength of the alloy. This relationship is illustrated by the data set forth in Table 1 for the room temperature tensile strength of AA 8009 determined at different cross head speeds. Standard tensile specimens with a 1 inch gauge length 0.25 inch diameter are used. All the tensile strength data in this document are carried out at the low strain rate and to ASTM specifications.

TABLE 1

Room temperature tensile strength of AA 8009 as a function of strain rate.

| Strain Rate [/SEC] | UTS [ksi] | EL. [%] |
|---|---|---|
| 0.00005 | 64.5 (1) | 14 (2) |
| 0.00100 | 66.0 (1) | 17 (2) |

EXAMPLES

The detailed examples that follow will illustrate how through the use of impact forging, surprisingly, high forging reductions are possible and the problems described above are virtually eliminated. This is surprising because the impact forging produces in the alloy shock waves and very high strain rates, which it was believed would shatter the material. The specific conditions set forth to illustrate the principles and practice of the invention are exemplary only, and should not be construed as limiting the scope of invention.

TABLE 2

Compositions of two dispersion strengthened alloys.

| Alloy | Fe % | Si % | V % | Al % |
|---|---|---|---|---|
| AA 8009 | 8.5 | 1.7 | 1.3 | balance |
| FVS 1212 | 11.7 | 2.4 | 1.2 | balance |

Example 1

A 4.5" diameter by 5" long billet of the alloy AA 8009 made by vacuum hot pressing is extruded using graphite lubrication and a conical die with a 120° included angle at a temperature of 380° C. to a 2"×¾" rectangle. Casting, powder production and extrusion are all carried out using standard procedures as outlined above. The extrusion is forged to a connecting rod for an internal combustion engine using existing dies, which normally forge 2 rods at a time from a 10 inch length. The procedures currently used for steel connecting rods are employed, these involve the use of an old hammer press, which deforms the material at very high strain rates. The AA 8009 alloy is forged at 400 to 420° C., the die lubricant used is a commercially available graphite based lubricant, which is coated on the dies. In addition, the standard graphite spray lubricant employed for the steel forgings is used. This and the initial reduction in blow energy to minus one-third (−⅓) that used for steel were the only differences in forging the AA 8009 and the steel. The tensile strength is measured after extrusion. Despite the relatively high forging temperatures used, the loss in strength during forging is only 5 to 15 MPa, which loss is considered to be minimal.

Example 2

A 10" diameter billet of alloy AA 8009 produced by degassing powder in a can, blank die compacting the can and then machining off the can, is extruded with no lubricant using a shear die to a 3.3" diameter round, using a 4,000 T press. The extrusion temperature is 420° C. The casting, powder and extrusion conditions are the same as those used in Example 1. The extrusion is forged to a starter using a 5,000 lb steam hammer and simple existing dies designed for titanium. This starter is essentially a 7" diameter impeller that additionally includes a shaft, and is more complex than the impeller forging described hereinabove. The starter is forged using the steam hammer in two operations. Graphite lubricant is used and the forging temperature is 375° C. The dies are preheated to about 150 to 200° C. Forging resulted in parts being made. However, the material does not flow into and completely fill the shafts and several parts crack during forging. The problem is the steam hammer forging, so a hydraulic press should be used. The same tooling is switched to a 2,500 Ton hydraulic press, and extruded stock produced as described in this Example is forged therein using the same furnace to preheat the stock and the same dies as were used for the hammer forging. The dies are preheated to a temperature of about 325° C. Hence, conditions approaching isothermal forging are used. The ram speed is 10 to 20 inches/min. It is surprisingly found that the forging is much less successful than the hammer forging, with extensive cracking occurring and very little flow into the shaft. No parts are produced using this approach. Attempts to produce parts by multiple hits in the same die the use of slower forging speeds and improved lubrication are unsuccessful. This comparison of the two techniques clearly demonstrated the superiority of high speed forging.

Example 3

The starters produced by hammer forging in Example 2 are successful in the initial evaluation, resulting in a need for more starters for continued evaluation. These additional starters should be hammer forgings. This results in additional precautions being taken in preparation of these hammer forgings over those previously employed. The powder is made in the conventional way. Specifically, it is compacted to 11 inch diameter 150 lb billets using a 1600 ton vacuum hot press. The billets are machined to 10" diameter and are extruded to 3" diameter using shear dies with little or no lubrication. A press of 7,000 T is used, which allows the extrusion temperature to be reduced to 360° C., hence higher strength extrusions are produced. The starter is forged using the same 5,000 lb hammer and dies as in Example 2. The dies are preheated to around 250° C. Extensive graphite lubrication is used on the dies. During forging the hammer is used with maximum force instead of being restrained. Forging to the finished starter takes only 2 operations and no problems are encountered. Due to the better preparation and hammer forging allowing full force on the 5,000 lb hammer to be used, die fill is excellent. Extensive flash is thrown, which had not occurred previously.

The tensile strength of these starters is close to that of the starting extrusion, as set forth in Table 3. The strength is 96% of extruded starting stock. This is surprising because although the billet temperature going into the dies is low, about 325 to 370° C., the exit temperature, 425° C., is high due to the temperature rise caused by work done on the part during forging and the adiabatic conditions. It can be concluded that hammer forging improves formability, but the temperature rise during forging surprisingly does not result in a loss in strength. Growth of dispersoids can result in a loss of ductility as well as a loss in strength, because the dispersoids do not keep their near spherical shape, but instead form rod-like shapes which reduce ductility and toughness. Table 3 shows that as well as high strength, the forgings have a high ductility. Both the tensile elongation and the reduction in area are high.

TABLE 3

Tensile properties of 8" diameter starter forging of AA 8009. Forged in 2 operations from 3" diameter extrusion. Tested at 0.025"/min.

| | YS [ksi] | UTS [ksi] | EL. [%] | RA. [%] |
|---|---|---|---|---|
| Axial | 53.5 | 62.7 | 17 | 55 |
| Diameter | 55.5 | 62.5 | 15 | 50 |
| Chord 1" from Dia. | 57.5 | 64.1 | 13 | 45 |

TABLE 3-continued

Tensile properties of 8" diameter starter forging of AA 8009. Forged in 2 operations from 3" diameter extrusion. Tested at 0.025"/min.

| | YS [ksi] | UTS [ksi] | EL. [%] | RA. [%] |
|---|---|---|---|---|
| Chord 2" from Dia. | 57.7 | 64.1 | 13 | 50 |
| Chord next Circum. | 57.2 | 63.8 | 13 | 45 |
| Radial | 55.5 | 62.6 | 9 | 30 |

Example 4

Starters are also made from another rapidly solidified dispersion strengthened alloy, designated FVS 1212 and shown in Table 2. Casting, powder production, and extrusion are all carried out using the procedures set forth in Examples 1 and 2 for AA 8009. The alloy FVS 1212 has the same strengthening dispersoid as AA 8009, but the volume fraction is 33% rather than the 26% of alloy AA 8009. This high volume fraction results in a higher strength, but reduced ductility. The forgings are carried out with material extruded using the same procedures as set forth in Example 3, except that a slightly higher extrusion temperature, 440° C., is used, as is normal for the FVS 1212 alloy. The extrusion is also forged at a higher temperature, 440° C., because of the problems anticipated from its low ductility. Starters are forged in 2 operations just as for Example 3. These forgings show no sign of cracking or other forging defects. The tensile properties of these forgings are set forth in Table 4. The strengths—99% of extruded starting stock—are only slightly lower than those of the starting extrusion. Optimization of the forging process would undoubtedly result in a lower forging temperature and no loss in strength during forging.

TABLE 4

Tensile properties of 8" diameter starter forging of FVS 1212. Forged in 2 operations from 3.2" diameter extrusion. Tested at 0.025"/min.

| | YS [ksi] | UTS [ksi] | EL. [%] | RA. [%] |
|---|---|---|---|---|
| Axial | 60.5 | 76.0 | 13 | 25 |
| Diameter | 63.3 | 72.0 | 5 | 10 |
| Chord 1" from Dia. | 64.5 | 74.6 | 8 | 13 |
| Chord 2" from Dia. | 64.0 | 74.5 | 7 | 12 |
| Chord next Circum. | 61.2 | 74.1 | 7 | 12 |
| Radial | 68.5 | 76.5 | 6 | 12 |

Example 5

An impeller forging is also carried out using the 5,000 lb steam hammer. The impeller is 7.5" diameter and is normally forged from titanium. Only one die was used after an open die upset operation. A 3" diameter extrusion of alloy AA 8009 is used that had been fabricated in the same manner as that used in Example 3. The material is forged at a low temperature, about 320° C. Forging is successfully carried out in 1 operation with no reheats. The extrusion is upset and forged to the impeller shape in the one operation. Comparison with the impeller forging of Example 2 shows that for a slightly thicker impeller, using a hydraulic press necessitates at least 4 operations. The tensile strengths of these impellers were again identical to the strengths of the starting extrusions. Strength is 100% of extruded starting stock. The temperature of the part emerging from the dies was about 420° C., confirming that the temperature rise during near adiabatic forging does not result in a loss in strength.

TABLE 5

Tensile properties of 7" diameter impeller forging of AA 8009. Forged in 1 operation from 3" diameter extrusion. Tested at 0.025"/min.

| | YS [ksi] | UTS [ksi] | EL. [%] | RA. [%] |
|---|---|---|---|---|
| Axial | 56.0 | 65.6 | 14 | 50 |
| Diameter | 55.0 | 63.1 | 9 | 23 |
| Chord 1" from Dia. | 55.5 | 63.5 | 10 | 33 |
| Chord 2" from Dia. | 54.6 | 63.5 | 11 | 30 |
| Chord next Circum. | 60.0 | 65.2 | 905 | 25 |
| Radial | 60.4 | 65.2 | 7 | 12 |

The alloy FVS 1212 is also forged to this impeller. The starting stock is again the 3" diameter material used in Example 4. The forging temperature is 400° C. Surprisingly, even for this difficult-to-forge alloy the forging is successfully accomplished in one operation with no reheats. The tensile properties of the forged impeller shown in Table 6, are close to those of the starting extrusion. Strength is 99% of extruded starting stock.

TABLE 6

Tensile properties of 7" diameter impeller forging of FVS 1212. Forged in 1 operation from 3.2" diameter extrusion. Tested at 0.025"/min.

| | YS [ksi] | UTS [ksi] | EL. [%] | RA. [%] |
|---|---|---|---|---|
| Axial | 57 | 72.5 | 6.5 | 5 |
| Diameter | 61 | 74.5 | 5 | 5 |
| Chord 1" from Dia. | 63 | 75.0 | 5 | 5 |
| Chord 2" from Dia. | 62 | 74.5 | 5 | 5 |
| Chord next Circum. | 61 | 73.0 | 4 | 4 |
| Radial | 70 | 74.3 | 3 | 4 |

Example 6

A "cover" is forged from the AA 8009 alloy using the steam hammer. The cover is approximately a 140 mm outer diameter tube with one end closed. The internal diameter is around 90 mm and the end is around 20 mm thick. Some details exist on the outer diameter. A 10.5" diameter VHP is upset to 12" diameter and extruded to 3.5" diameter using shear dies and the 7,000 T press. Forging dies are fabricated specifically for this job. A 1,200 lb hammer is initially used to close die upset the extrusion to 4" diameter. This is necessary to prevent the long forging billet from buckling. Subsequently, the 5,000 lb steam hammer is used, as in the previous Examples. The billet is forged in 2 or 3 operations using the same die, but with 1 or 2 reheats, to the external shape of the cover with no problem. However, it is difficult to form the inside diameter of the cover. This operation requires back extrusion, which is relatively easy for the AA 8009 alloy. Forgings of the inside form of the cover are made using very soft blows of the hammer press with numerous reheats. That operation is, however, not a viable production mode. Accordingly, the benefits of hammer forging are related to shock waves and are realized in an operation such as upsetting moved material in the direction of the shock waves. The cover, however, being formed by a back extrusion process, tends to move material in a direction opposite to the initial shock waves. Accordingly, the same dies are used on a 2,500 T hydraulic press, and the die temperature is set at about 370° C. For this back extrusion, the hydraulic press is much more successful. Hence, it is concluded for this part that the optimum fabrication sequence is one hammer forging to upset the extrusion and form the external shape followed by back extrusion on a hydraulic press to form the internal shape.

This confirms the importance of shock waves in forging the AA 8009 alloy, indicating that it is not only high strain rates which are advantageous in forging the alloy, but also the impact conditions that produce shock waves. The impact conditions may be more important than the high strain rates. This is particularly significant in view of the known increase in strength of the alloy with increasing strain rates. A higher strength material would be assumed to be more difficult to forge.

Example 7

A 7.5" diameter 9 lb impeller was forged using the same extruded stock as described in Example 6, except that, to clean up surface defects, the stock is machined to 3.3" diameter. As in Example 6, a 1,200 lb hammer is used to close die upset the stock to 4" diameter. The 4" diameter stock is forged on a 10,000 lb steam hammer to the 7" diameter impeller in one operation. No cracking in the impeller occurs and an extensive crack free flash is thrown. The stock temperature is around 350° C. and the dies were heated only to 260 to 300° C. Standard graphite base lubricant is used.

The tensile strength of the forged impeller is within 1 ksi of the starting extrusion. Good ductilities are obtained in all directions. The impact forging described in this Example is based on a single iteration and has already a better strength retention and a much lower reject rate (0 compared to 30%) than forgings produced using a hydraulic press. In addition, the impact forging is closer to the finished shape, so subsequent iterations could start with up to a 1 lb lighter stock weight, permitting additional savings in material and machining costs.

Having thus described the invention in rather full detail, it will be understood that such detail need not be strictly adhered to but that various changes and modifications may suggest themselves to one skilled in the art, all falling within the scope of the invention. as defined by the subjoined claims.

What is claimed is:

1. A process for forming a dispersion strengthened aluminum alloy to a shaped part comprising the steps of:

(a) providing a dispersion-strengthened aluminum alloy billet having a density of at least 90% of theoretical density, the billet being formed to said density by compaction, extrusion, or pressing; and (b) impact forging said billet with a steam hammer, an impact press, or a high energy rate forming press at a temperature of at least about 275° C. to about 450° C. to produce shockwaves, wherein said impact forging step (b) consists of one or two impact forging iterations to forge the billet to conform to the shape of a forging die and thereby shape said stock into said shaped part, wherein said dispersion-strengthened aluminum alloy billet has a composition described by the formula $Al_{bal}Fe_aSi_bX_c$, wherein X is at least one element selected from the group consisting of Mn, V, Cr, Mo, W, Nb, and Ta, "a" ranges from 2.0 to 7.5 weight-%, "b" ranges from 0.5 to 3.0 weight-%, "c" ranges from 0.05 to 3.5 weight-%, and the balance is aluminum plus incidental impurities, with the proviso that the ratio [Fe+X]:Si is within the range of from about 2:1 to about 5:1.

2. The process of claim 1, wherein the forging of the dispersion strengthened aluminum alloy has dispersoids that are near spherical in shape.

3. The process of claim 1, wherein the dispersion strengthened aluminum alloy comprises from 5 to 45 volume % dispersoids.

4. The process of claim 1, wherein the impact forging step (b) consists of a single impact forging iteration.

5. A process for forming a rapidly solidified dispersion strengthened aluminum alloy powder to a shaped part comprising the steps of:

(a) extruding a billet made from said powder at an extrusion ratio of at least 4:1 to produce an extrudate billet, wherein said extrudate billet has a density of 100% of theoretical density; and (b) impact forging the extrudate billet at a temperature of at least about 275° C. to about 450° C. using a forging die to produce shockwaves, wherein said impact forging step (b) consists of a single forging iteration to forge the extrudate billet to conform to the shape of the forging die and thereby form said shaped part, wherein said extrudate billet has a composition described by the formula $Al_{bal}Fe_aSi_bX_c$, wherein X is at least one element selected from the group consisting of Mn, V, Cr, Mo, W, Nb, and Ta, "a" ranges from 2.0 to 7.5 weight-%, "b" ranges from 0.5 to 3.0 weight-%, "c" ranges from 0.05 to 3.5 weight-%, and the balance is aluminum plus incidental impurities, with the proviso that the ratio [Fe+X]:Si is within the range of from about 2:1 to about 5:1.

6. The process of claim 5, wherein step (b) is carried out using a steam hammer.

7. The process of claim 5, wherein step (b) is carried out using an impact press.

8. The process of claim 5, wherein step (b) is carried out using a high energy rate forming press.

9. The process of claim 5, wherein the die has a temperature of at least 200° C.

10. The process of claim 5, wherein the extrudate as forged in step (b) has at least 95% of the strength of the billet extruded in step (a).

11. A process for forging a dispersion strengthened aluminum alloy, comprising:

providing a dispersion-strengthened aluminum alloy billet having a density of at least 90% of theoretical density, wherein said dispersion strengthened aluminum alloy has a composition described by the formula $Al_{bal}Fe_aSi_bV_dX_c$, wherein X is at least one element selected from the group consisting of Mn, Mo, W, Cr, Ta, Zr, Ce, Er, Sc, Nd, Yb, and Y, "a" ranges from 2.0 to 7.5 weight-%, "b" ranges from 0.5 to 3.0 weight-%, "d" ranges from 0.05 to 3.5 weight-%, "c" ranges from 0.02 to 1.50 weight-%, and the balance is aluminum plus incidental impurities, with the proviso that the ratio [Fe+X]:Si is within the range of from about 2:1 to about 5:1, impact forging to conform to the shape of a die the aluminum alloy billet in an impact forging process that consists of no more than two impact forging operations at a temperature of at least about 275° C. to about 450° C. to produce shockwaves, wherein the impact forging is performed using a steam hammer, an impact press, or a high energy rate forming press, and wherein said impact forging results in a billet that is conformed to the die.

12. The process of claim 11, wherein impact forging process consists of a single impact forging operation.

* * * * *